United States Patent [19]

Biela et al.

[11] 4,000,526

[45] Jan. 4, 1977

[54] TOILET FLUSHING APPARATUS

[76] Inventors: John A. Biela, 9296 Callero Drive, Niles, Ill. 60648; H. Paul Weirich, Box 164 Rte. 1, Libertyville, Ill. 60048

[22] Filed: Mar. 26, 1975

[21] Appl. No.: 562,311

[52] U.S. Cl. ..... 4/57 P; 4/34; 4/67 A

[51] Int. Cl.[2] ..... E03D 1/34; E03D 1/14; E03D 3/12

[58] Field of Search ..... 4/57 P, 67 A, 67 R, 4/57 R, 37, 34, DIG. 1

[56] References Cited

UNITED STATES PATENTS

| | | | |
|---|---|---|---|
| 1,890,281 | 12/1932 | Dollinger | 4/67 A |
| 2,629,879 | 3/1953 | Bennett | 4/57 P |
| 2,741,776 | 4/1956 | Christie et al. | 4/67 A X |
| 2,754,521 | 7/1956 | Marcum | 4/57 R |
| 3,320,622 | 5/1967 | Wustner | 4/67 R |
| 3,331,084 | 7/1967 | Wustnar | 4/57 R |
| 3,365,730 | 1/1968 | Chiappetta | 4/67 R |
| 3,546,715 | 12/1970 | Wustner | 4/67 A |
| 3,831,204 | 8/1974 | Cook | 4/57 R |
| 3,858,250 | 1/1975 | Coglitore | 4/67 A |

*Primary Examiner*—Henry K. Artis
*Attorney, Agent, or Firm*—Bernard L. Kleinke

[57] ABSTRACT

Toilet flushing apparatus for use in a toilet assembly having a drain valve seat, includes a flush valve assembly for enabling a partial flushing operation to occur for conserving the use of water. The flushing valve assembly includes a floating flapper valve device for sealing the drain valve seat, the floating flapper valve device including an air trapping float chamber and an inlet mounted in fluid communication with the chamber for trapping air in the chamber to delay the closing of the flapper device. A vent mounted in fluid communication with the chamber enables at least some of the trapped air to be released from the chamber for enabling the flapper device to close prematurely, thereby causing a partial flush operation to occur. In one form of the invention, a trip lever assembly directly controls the operation of the floating flapper valve device for full flush operations, and it is adapted to control the vent for a partial flushing operation.

10 Claims, 4 Drawing Figures

Fig. 1
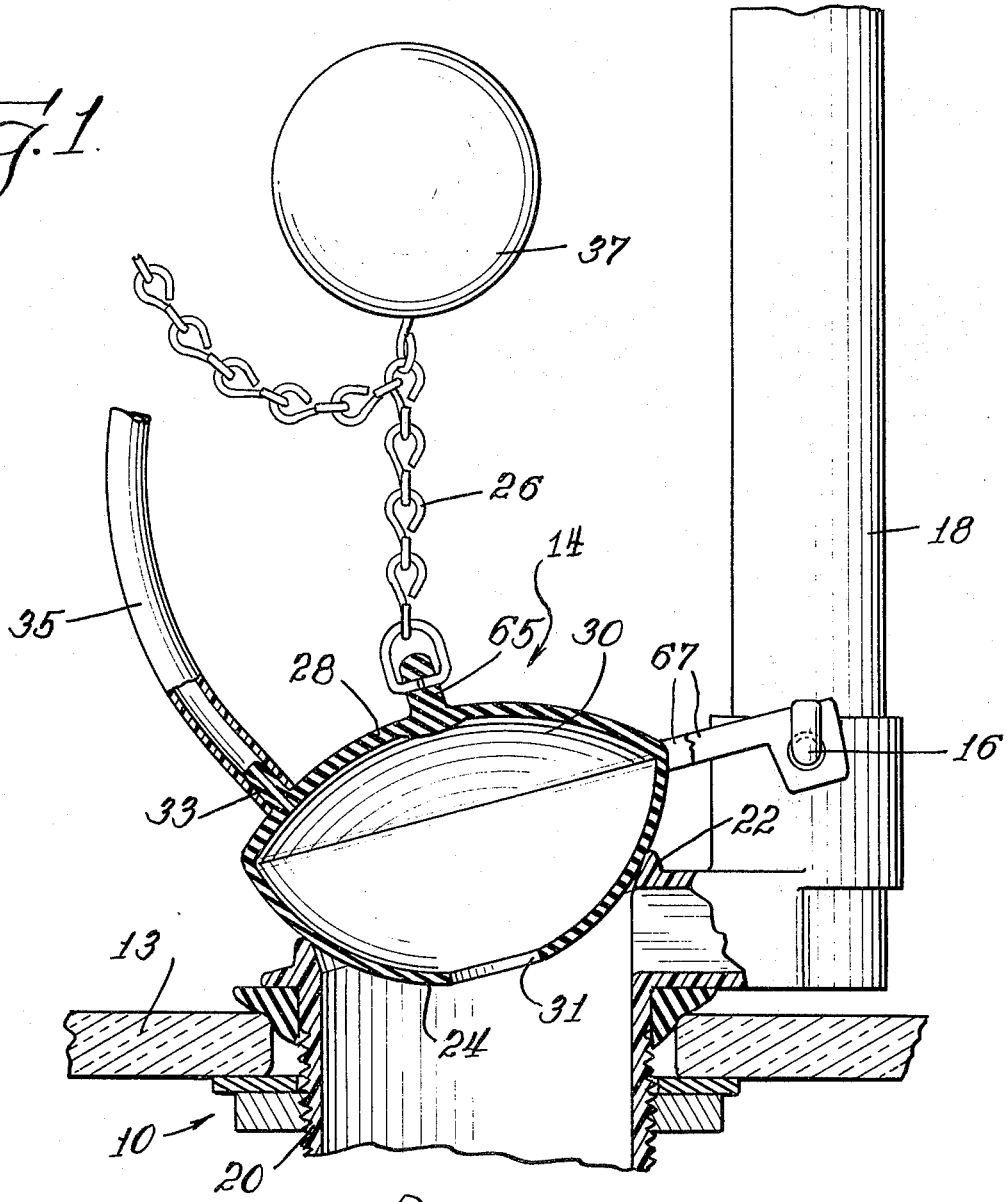
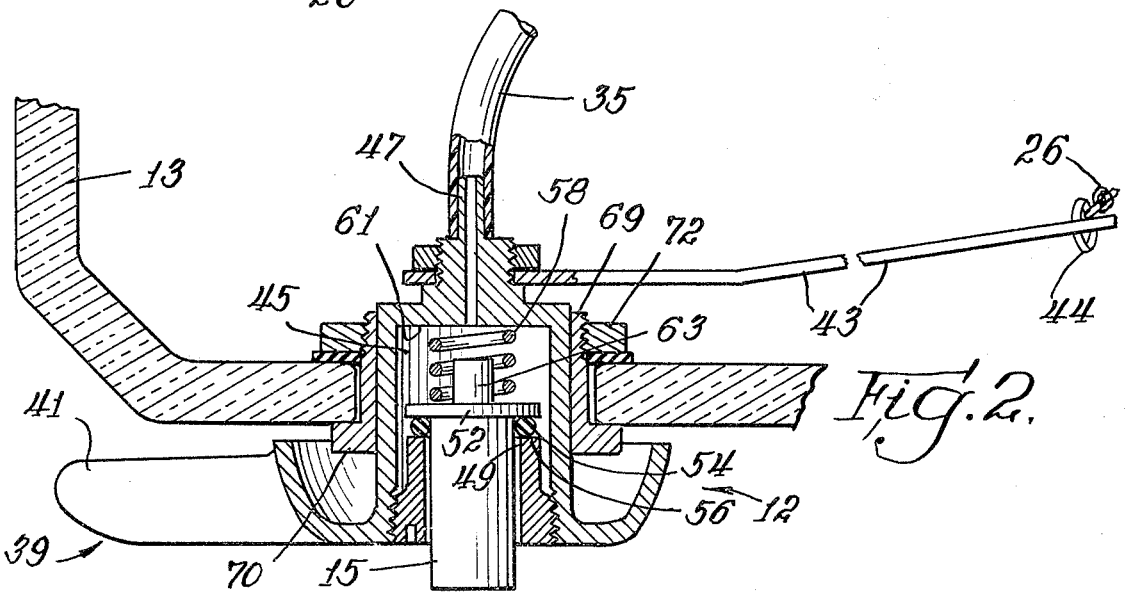
Fig. 2.

TOILET FLUSHING APPARATUS

The present invention relates to toilet flushing apparatus, and it more particularly relates to toilet flushing apparatus which enables a partial flushing of a toilet, as well as a complete flushing operation, for the purpose of conserving water.

Water conservation is an important concern since water in many areas is either scarce or expensive or both. Therefore, it is highly desirable to reduce the amount of water needed for flushing toilets. Certain types of flushing apparatus have been emloyed to enable the user to select either a complete or full flush of the water from the toilet tank into the toilet bowl, or a partial flushing operation, such as permitting one half of the water from the toilet tank to empty into the toilet bowl for flushing purposes. For example, reference may be made to the U.S. Pat. No. 3,744,064. However, while such an apparatus as disclosed in the above-mentioned patent is satisfactory for some applications, it would be highly desirable to have flushing apparatus which is relatively inexpensive to manufacture and which is highly reliable in operation. Moreover, such apparatus should be simple to use, and it should be of the type which can convert existing toilets to ones which operate on the water saving partial flushing principle.

Therefore, the principal object of the present invention is to provide new and improved toilet flushing apparatus, which enables the toilet to operate in the partial flushing mode of operation, and which is relatively inexpensive to manufacture and convenient to use.

Another object of the present invention is to provide such a new and improved flushing apparatus which is adapted to readily convert existing toilets to ones which operate according to the partial flushing mode of operation.

Briefly, the above and further objects of present invention are realized by providing toilet flushing apparatus for a toilet tank drain valve seat, the flushing apparatus including a floating flapper valve device for sealing the drain valve seat, the floating flapper valve device having an air trapping float chamber and an inlet mounted in fluid communication with the chamber for trapping air in the chamber to delay the closing of the flapper device over the toilet tank drain valve seat for a given time delay interval. A vent is mounted in fluid communication with the float chamber for releasing trapped air from the chamber to decrease the time for closing of the flapper device over the drain valve seat to provide a partial flushing operation. A trip lever assembly may be provided for controlling the operation of the floating flapper valve device for full flushing operations, and it is adapted to control the vent for a partial flushing operation. In one form of the invention, a tube is connected at one of its ends to the vent for the float chamber and at its other end to the trip lever assembly, whereby the tube can be opened or closed by means of the trip lever assembly for providing either a partial or a complete, respectively, flushing operation.

The above, and still further highly important objects and advantages of the invention will become apparent from the following detailed specification, appended claims, and attached drawings, wherein:

FIG. 1 is a vertical cross-sectional view, partially broken away, of a toilet float valve assembly which is constructed in accordance with the present invention;

FIG. 2 is a cross-sectional plan view of a toilet trip lever assembly which is constructed in accordance with invention and which is illustrated mounted to a toilet water storage tank shown fragmentarily;

Figure 3:
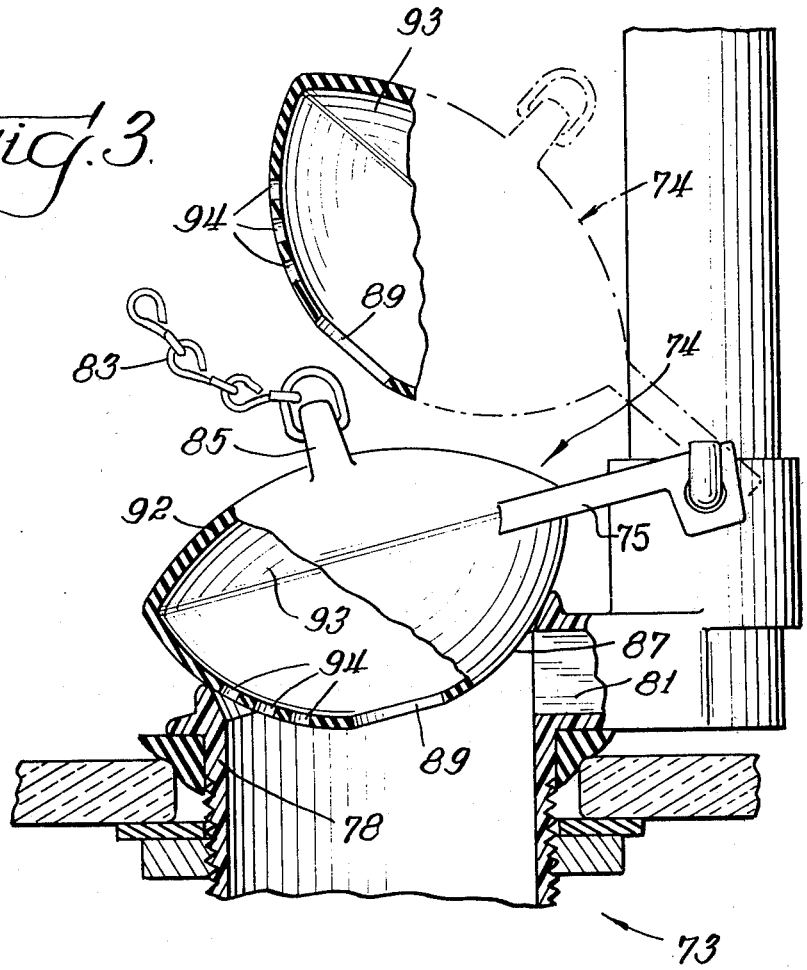
FIG. 3 is another float valve assembly which is constructed in accordance with the present invention.

Referring now to the drawings, and more particularly to FIGS. 1 and 2 thereof, there is shown a flapper valve assembly 10 (FIG. 1), which is constructed in accordance with the present invention and which is controlled by a trip lever assembly 12 (FIG. 2) mounted in a toilet water storage tank 13, the trip lever assembly 12 also being constructed in accordance with the present invention. The manually operated trip lever assembly 12 moves a floating or buoyant flapper valve device 14 of the flapper valve assembly 10 for providing either a partial or a complete toilet flushing operation as hereinafter described in greater detail. A manually-operated push button 15 of the trip lever assembly 12, when pushed, enables the flapper valve assembly 10 to operate in the partial flushing mode of operation as hereinafter described in greater detail.

Considering now the flapper valve assembly 10, the floating flapper valve device 14 is pivotally mounted at 16 to a refill tube 18. A tank drain or discharge pipe 20 having an inclined annular valve seat 22 connects the toilet tank 13 in fluid communication with the toilet bowl (not shown) when the flapper device 14 is moved out of engagement with the valve seat 22 as it pivots about the point 16. The valve device 14 includes a flapper valve member 24 which is adapted to fall under the force of gravity into sealing engagement with the valve seat 22 at the end of a flushing operation. A chain 26 extends to and is controlled by the trip lever assembly 12 as hereinafter described in greater detail to pull the floating flapper valve device 14 upwardly so that the flapper valve member 24 moves out of sealing engagement with the valve seat 22. An upper float member 28 of the flapper valve device 14 includes a float chamber 30 for trapping air therein to serve as a float for delaying for a given time delay interval the closing of the flapper valve device 14 once the trip lever assembly 12 releases the upwardly exerted force on the chain 26. A large central inlet opening 31 in the lower flapper valve member 24 enables air to enter the float chamber 30 from the toilet bowl via the tank drain 20 when the floating flapper valve device 14 is in its closed position as indicated in FIG. 1. The lower valve member 24 and the upper float member 28 are integrally connected together to form a generally oval shaped or flattened hollow ball.

In accordance with the present invention in order to provide for a partial flushing mode of operation, a small vent opening 33 in the upper float member 28 mounted in fluid communication with the float chamber 30 releases trapped air from the float chamber to decrease the time for closing of the flapper device over the drain valve seat 22. A tube 35 has its one end attached to the upper float member 28 in fluid communication with the float chamber 30 via the vent opening 33, the other end of the tube 35 being connected in fluid communication with the trip lever assembly 12 as hereinafter described in greater detail. In this regard, the trip lever assembly 12 controls the opening and closing of the vent opening 33 to produce either a partial or a complete flushing operation. When the tube 35 is closed by means of the trip lever assembly 12, the floating flapper valve device 14 with trapped air in the float chamber 30 closes the valve seat 22 within the full given time delay interval to cause a complete or full flushing operation. When the trip lever assembly 12 permits the tube 35 to remain open to the atmosphere, trapped air is permitted to escape from the float chamber 30 through the vent opening 33 and the tube 35 to the atmosphere via the trip lever assembly 12 as hereinafter described in greater detail, whereby the flapper valve device 14 closes more quickly to provide a partial flushing operation. A float 37 composed of buoyant material such as styrofoam, is attached to the chain 26 at a predetermined distance from the upper float member 28 to provide the necessary time delay for the partial flushing operation. In this regard, when the flapper valve device 14 is pulled open by the chain 26 and the tube 35 is open to the atmosphere and when the trip lever assembly 12 releases the chain 26, the float 37 prevents the device 14 from closing immediately under the force of gravity and instead floats downwardly as the level of water falls within the toilet bowl 13. The float 37 is attached to the chain 26 at a sufficient distance from the device 14 to enable it to close when the water level in the tank 13 is at a desired partial flushing level, such as half full, thereby achieving a partial flushing mode of operation.

Considering now the trip lever assembly 12 in greater detail with reference to FIG. 2 of the drawings, the trip lever assembly 12 includes a handle member 39 pivotally connected to the toilet water storage tank 13 for selecting either a partial flush operation or a complete flush operation of the toilet tank 13. The handle 39 includes a trip lever handle 41 on the outside of the tank 13 so that the user can grasp it and rotate the handle member 39 for controlling the flapper valve assembly 10. A trip lever 43 is fixed to the handle member 39 on the inside of the toilet tank 13 and is connected at its outer distal end to the chain 26 by means of a hook 44 extending through an opening in the lever 43. A vent chamber 45 in the handle member 39 has a vent opening 47 at its rear end portion within the toilet tank 13 whereby the upper end of the tube 35 is attached to the handle member 39 in fluid communication with the vent chamber 45. A vent opening 49 at the front end of the handle member 39 outside of the toilet tank 13 is normally closed to the atmosphere by a peripheral flange 52 within the vent chamber 45 on the push-button 15. A seal 54 surrounds the button 15 between the flange 52 and an annular shoulder 56 of the handle member 39 surrounding the opening 47. A coil spring 58 disposed within the chamber 45 extends between a rear internal annular shoulder 61 of the handle member 39 and the peripheral flange 52 surrounding a boss 63 thereon to urge resiliently the flange 52 forwardly toward the annular shoulder 56 to close off the opening 49 to seal the tube 35 from the atmosphere. When a partial flush operation is desired, the button 15 is pushed inwardly to open the chamber 49 to the atmosphere via the opening 49.

Considering now the flapper valve assembly 10 in greater detail, an apertured tab 65 extends from the central portion of the outside of the upper float member 28 to attach to the bottom end of the chain 26. A pair of parallel spaced-apart arms 67 integrally connected to the flapper valve device 14 receives and is pivotally connected to the refill tube 18 at their distal ends. The arms 67 are composed of resilient material, such as rubber, to enable the arms to flex when the chain 62 pulls the device 14 upwardly into an open position.

Considering now the trip lever assembly 12 in greater detail, in order to pivotally mount the assembly 12 to the toilet tank 13, a sleeve 69 extends through an opening in the tank 13 and surrounds the handle member 39 to enable it to rotate about its axis within the sleeve 69. An annular shoulder 70 of the sleeve 69 at the outside of the tank 13 engages the tank 13 and is held in place by a nut 72 threaded onto the rear end portion of the sleeve 69 within the tank 13.

Considering now the operation of the toilet flushing apparatus of the present invention, when a full or complete flush of the toilet is desired, the trip lever handle 41 of the handle member 39 is grasped by the user and rotated downwardly as viewed in FIG. 2 of the drawings to rotate the handle member 29 within the sleeve 69 to cause the lever 43 to raise within the tank 13, whereby the chain 26 is also raised. The raising of the chain 26 causes the floating flapper valve device 14 to be pulled upwardly out of sealing engagement with the seat 22 and pivot about the point 16, the arm not fully shown in the drawings being pivoted about a similar point (not shown) on the backside of the refill tube 18. After the device 14 is raised to its uppermost position, the user releases the handle 41. The water in the storage tank 13 empties into the toilet bowl (not shown) through the tank discharge drain 20 connecting the storage tank 13 in fluid communication with the bowl for flushing purposes. The device 14 gradually returns to its closed position in engagement with the valve seat 22 as the water lever falls within the storage tank 13 until the flapper valve member 24 of the device 14 moves into sealing engagement with the valve seat 22 to seal the discharge drain. When the device 14 seals the drain 20, substantially all of the water has emptied from the tank 13 into the toilet bowl 13. Thereafter, conventional apparatus disposed within the storage tank 13 enables water to flow into the storage tank 13 to replenish the water supply. During this refilling operation, water enters the drain 20 via the refill tube 18 to supply water to the toilet bowl in a conventional manner. At this time, air from the toilet bowl through the drain 20 enters the float chamber 30 via the large opening 31 to replenish any air that might escape from the chamber 30 during the flushing operation. Also, the handle 41 returns to its normal horizontal position as shown in FIG. 2 when the device 14 is in the closed position as shown in FIG. 1.

Considering now a partial flushing operation, the user grasps the handle 41 and rotates it downwardly in the same manner as for a complete flushing operation, but at the same time the user presses the button 15 inwardly with the thumb of the user to initiate the partial flushing operation. The movement of the button 15 inwardly causes the flange 52 to move out of engagement with the seal 54 and the shoulder 56 to enable the vent chamber 45 to be connected in fluid communication with the atmosphere via the opening 49. Thus, the float chamber 30 is then connected in fluid communication with the atmosphere through the tube 35 via the vent opening 33 of the float chamber 30 and the vent opening 47 of the vent chamber 45. As a result, trapped air within the float chamber 30 is permitted to escape to the atmosphere to prevent the float chamber 30 from being buoyant and thus controlling the return of the device 14 to its closed position as shown in FIG. 1.

As the handle 41 rotates, the chain 26 pulls the device 14 into its open position in a manner similar to the full or complete flushing operation. However, the float chamber 30 is either partially or completely inoperative due to the venting of the chamber 30 to the atmosphere. The float 37 maintains the device 14 in its open position and gradually permits it to fall into its closed position as the water level in the tank 13 falls when the water flows through the drain 20 into the toilet bowl. When the water level has fallen sufficiently within the tank 13, the device 14 falls into its closed position as shown in FIG. 1 since the float 37 is connected to the chain 26 at a sufficient predetermined distance from the device 14. Thereafter, water then flows into the tank 13 in the conventional manner to return the level of the water in the tank to its predetermined height as determined by another float (not shown) and a ball cock assembly (not shown) in the conventional manner. At the same time, water enters the toilet bowl via the refill tube 18 in the conventional manner. It should be understood that the water entering the bowl through the refill tube 18 flows for a correspondingly shorter length of time than during the full flush operation, and thus it may be desirable to adjust the amount of water entering the bowl through the refill tube 18 by suitable adjustments to the supply valves or by adjusting the size of the orifices as is well known in the art. Also, it will be understood to those skilled in the art that the float 37 may be eliminated by selecting a suitable size opening for the vent opening 33 so that all of the trapped air does not escape, whereby the buoyancy of the device 14 is adjusted accordingly to provide the desired partial flushing operation. Also, if desired, there can be some trapped air remaining in the chamber 13 and the float 37 may also be employed to obtain the desired results. The size and material of the float 37 may be determined by those skilled in the art to obtain the desired results. When using the float 37, the amount of water leaving the tank 13 can be adjusted by merely attaching the float 37 to the chain 26 at an adjusted position to cause the device 14 to close at the desired time to retain a desired amount of water within the tank 13.

Considering now a flapper valve assembly 73 shown in FIG. 3 of the drawings, the assembly 73 is similar to the assembly 10 except that there is no necessity of providing a tube for connecting the assembly 73 to a special trip lever assembly 12 since any conventional trip lever assembly may be employed. The flapper valve assembly 73 includes a floating flapper valve device 74, which is similar to the device 14 of FIG. 1, and which has a pair of arms, such as the arm 75, of similar construction to the arms of the device 14, for moving into sealing engagement with an inclined annular valve seat 76 of a bowl drain 78. A refill tube 81 is similar to the tube 18, and a chain 83 connected to an apertured tab 85 of the device 74 pulls the device 74 upwardly in a similar manner to the chain 26 of FIG. 1 in response to a conventional trip lever assembly (not shown). A flapper valve member 87 of the device 74 seals the seat 76 as shown in complete solid lines in FIG. 3, and it permits the water in the tank (not shown) to empty into the toilet bowl (not shown) through the drain 78 when the device 74 is in the position partially shown in dotted lines in FIG. 3. A large central opening 89 in the flapper valve member 87 permits air to enter an upper float member 92 having a float chamber 93 when the device 74 is disposed in its position as indicated in FIG. 3. When the device 74 is in its open position as indicated in the partially broken line showing in FIG. 3, a series of vent openings 94 in the flapper valve member 87 permits air to be released from the chamber 93 to the water within the tank to serve the same purpose as the vent opening 33 in the device of FIG. 1. The openings 94 are disposed outwardly from the large opening 89 so that when the device 74 is in its open position the holes are disposed near the uppermost portion of the device 74 to prevent the trapped air to bubble out of the device 74. The size and shape of the openings 94 are selected to establish the proper buoyancy of the device 74 to achieve the desired effect of a time delay in closing the device 74 into its position as shown in solid line in FIG. 3. In order to achieve a complete or full flush operation, the trip lever handle (not shown) must be held by the user in the down position to retain the device 74 in its open position until all of the water is emptied from the tank into the toilet bowl. Thereafter, the user may then release the handle to permit the device 74 to move into its closed position as shown in solid lines in FIG. 3. It should also be noted that to achieve an adjustment as to the amount of water during a partial flushing operation leaving the tank, additional holes may be added or one or more of the existing holes may be plugged or blocked.

Figure 4:
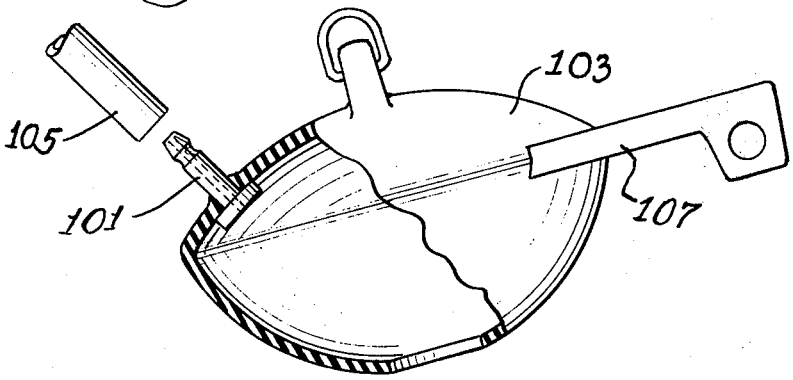
FIG. 4 is a view of a portion of yet another type of toilet flushing apparatus which is constructed in accordance with the present invention and which is adapted to convert existing toilet flushing apparatus to one enabling a partial flushing mode of operation.

Referring now to FIG. 4 of the drawings, there is shown a portion of a kit for modifying existing toilet flush mechanisms in accordance with the present invention. A nipple 101 is inserted into a conventional floating flapper valve device 103 through an opening therein, and a tube 105 is then slipped over the outside of the nipple 101 extending from the device 103, the other end of the tube 105 is then connected to a trip lever assembly such as the assembly 12 of FIG. 2. As a result, in order to convert an existing toilet flushing apparatus to a partial flushing apparatus in accordance with the present invention, the kit would comprise a trip lever assembly, such as the assembly 12 of FIG. 2, a length of tubing, such as the tube 105, and a nipple 101. The user would then insert a hole in the device 103 or an existing flushing apparatus to vent the air from the device 103 under the control of the trip lever assembly 12 in a convenient manner. A tool (not shown), such as an awl, may be used to punch the hole in the conventional flapper chamber device 103 at the appropriate location such as the location of the vent 33 of the device 14 shown in FIG. 1. In this regard, the vent should be disposed in the flapper valve device opposite the end thereof having arms, such as the arm 107, extending therefrom so that when the device is pulled into its open position, the vent will be near the uppermost position thereof for releasing the air trapped in the float chamber. The opening in the nipple is of a suitable size to provide a desired venting orifice to enable the device 103 to have the desired buoyancy to achieve a partially flushing operation without the need for a float, such as the float 37. To achieve different amounts of partial flushes, such as ¾ or ½, different size nipples may be included in the same kit.

While the present invention has been described in connection with particular embodiments thereof, it will be understood that many changes and modifications of this invention may be made by those skilled in the art without departing from the true spirit and scope thereof. For example, the flapper valve member and the float member having the float chamber may be separate items which are connected together rather than having them integrally connected to form a flattened ball as shown in the drawings. Also, the chain, such as the chain 26 of FIGS. 1 and 2, may be eliminated by employing the tube 35 to pull the floating flapper valve device 13 into its open position. Moreover, the trip lever assembly 12 of FIG. 2 may well be modified by those skilled in the art to permit the tube 35 to be normally open to the atmosphere instead of the normally-closed arrangement shown in FIG. 2. Accordingly, the appended claims are intended to cover all such changes and modifications as fall within the true spirit and scope of the present invention.

What is claimed is:

1. In toilet flushing apparatus including a toilet tank drain valve seat, a flush valve assembly comprising:

floating means for sealing the drain valve seat, said means including a float chamber for trapping air therein to delay for a given time delay interval the closing of said floating means over the drain valve seat, said means further including an inlet mounted in fluid communication with said chamber, said inlet being disposed within an area surrounded by the valve seat engaging portion of said floating means when it engages said drain valve seat; and means defining at least one vent opening mounted in fluid communication with said chamber and disposed within said area for releasing trapped air from said chamber to decrease the time for closing of said floating means over the drain valve seat when said floating means is moved away from said valve seat, said floating means being adapted to be mounted pivotally at one end portion thereof, said vent opening being disposed outwardly from said one end portion at the opposite outer end portion thereof spaced outwardly from said inlet, said means defining at least one vent opening being free of any connections therewith.

2. A flush valve assembly according to claim 1, wherein said floating means includes a valve member for sealing the valve seat and a float member connected to said valve member and having said float chamber, said inlet being a large opening for permitting air to enter said float chamber, said means defining at least one vent opening including a plurality of small vent openings disposed at the opposite end portion within said area.

3. A flush valve assembly according to claim 2, wherein said small vent openings are holes extending through the underside of said valve member.

4. A flush valve assembly according to claim 3, wherein said valve member and said float member are integrally connected together at their marginal edges.

5. A flush valve assembly according to claim 4, wherein said valve member and said float member form a hollow flattened ball, said large opening being centrally disposed on the underside of said flattened ball.

6. A flush valve assembly according to claim 5, wherein said plurality of small vent openings comprise three small closely spaced vent openings.

7. A flush valve assembly according to claim 1, further including a pair of spaced apart arms to adapt said floating means to be pivotally mounted.

8. A flush valve assembly according to claim 1, wherein said means defining at least one vent opening comprises a plurality of small vent openings.

9. A flush valve assembly according to claim 8, wherein said plurality of small vent openings comprise three small closely spaced vent openings.

10. A flush valve assembly according to claim 1, wherein said vent opening is disposed on the underside of said floating means.

* * * * *